United States Patent [19]

Johnsey et al.

[11] Patent Number: 4,805,709

[45] Date of Patent: Feb. 21, 1989

[54] DRILL BIT AND DRILL ASSEMBLY

[75] Inventors: Walter F. Johnsey, Birmingham; Donald D. Drummond, Jasper, both of Ala.

[73] Assignee: DRUMCO, Jasper, Ala.

[21] Appl. No.: 79,834

[22] Filed: Jul. 30, 1987

Related U.S. Application Data

[63] Continuation-in-part of Ser. No. 818,326, Jan. 13, 1986, abandoned.

[51] Int. Cl.[4] ..... E21B 10/18

[52] U.S. Cl. ..... 175/228; 175/337

[58] Field of Search ..... 175/228, 337, 339, 371

[56] References Cited

U.S. PATENT DOCUMENTS

| | | | |
|---|---|---|---|
| 2,814,464 | 11/1957 | Pike et al. | 255/303 |
| 2,831,660 | 4/1958 | Smiecinski | 255/304 |
| 3,029,881 | 4/1962 | Swart | 175/228 |
| 3,125,175 | 3/1964 | Medlock et al. | 175/337 |
| 3,924,695 | 12/1975 | Kennedy | 175/69 |
| 4,080,091 | 3/1978 | Hollingshead | 408/60 |
| 4,375,242 | 3/1983 | Galle | 175/228 |
| 4,428,442 | 1/1984 | Steinke | 175/228 |
| 4,508,183 | 4/1985 | Drummond | 175/69 |
| 4,541,494 | 9/1985 | Drummond | 175/228 |

*Primary Examiner*—William P. Neuder

*Attorney, Agent, or Firm*—Dann, Dorfman, Herrell and Skillman

[57] ABSTRACT

A drill bit for drilling into underground formations is disclosed, the drill bit having conduits for providing either lubricant or gaseous drilling fluid to the cutting cone bearings. In an alternate mode of operation, a mixture of lubricant and gaseous fluid is supplied to the bearings.

10 Claims, 2 Drawing Sheets

DRILL BIT AND DRILL ASSEMBLY

This application is a continuation-in-part of application Ser. No. 818,326, filed Jan. 13, 1986 now abandoned.

FIELD OF THE INVENTION

The present invention relates to a drill bit and drill assembly for drilling into earth formations, and more particularly to a drill bit and drill assembly having means for providing a controlled flow of lubricant, or combining a controlled flow of lubricant with gaseous drilling fluid to supply a lubricant and gaseous fluid mixture, to the cutting cones for lubrication or cooling of the cutting cone bearings.

DESCRIPTION OF THE PRIOR ART

Typical drill bits are used in combination with, for example, a rotary drill pipe system, for drilling deep holes into underground formations, such as into rock, coal, or the like. In a drilling system of this type, a drill string is formed by connecting a number of hollow extension pipes through which a drilling fluid, which may be either a drilling mud or a gaseous drilling fluid such as air, is supplied by way of the extension to the drill bit to be exhausted at the surface being drilled. The drill bit contains suitable openings, such as nozzles, for discharging the drilling fluid from the drill bit onto the surface being drilled to clear dust and cuttings and scavenge them away from the area of the cutting cones. The drill bit of the present invention is for use in connection with drilling systems using a gaseous drilling fluid.

In the above-described system, a subassembly may be located on the drill string between the drill bit and the extension pipe line. A subassembly structure is known in the art and generally includes a central conduit, or plenum chamber, which extends from the rotary drill extension pipe to the vicinity of the drill bit. Pressurized air or other gaseous drilling fluid from the rotary drill flows through the plenum chamber and is discharged downwardly through the drill bit, either through a central opening, or through nozzles positioned between the cutting cones.

A source of major concern in the drilling art is protection of the cutting cones from excess wear and heat. It is desirable to lubricate or cool the cutting cone bearings and shafts, which increases the useful life of the cutting cones and avoids the necessity of frequent drill bit replacement during a drilling operation. In the prior art, various systems have been employed to supply lubricant to the cutting cone bearings for lubrication during operation. In these systems, lubricant may be supplied from a storage means which is located either in the subassembly structure or in the drill bit itself. For example, in U.S. Pat. No. 3,029,881, a system is disclosed wherein a lubricant storage means is provided in a subassembly. The pressure of the gaseous fluid in the subassembly plenum chamber acts upon an expandable liner to force lubricant from the storage means, and into a lubricant supply conduit provided in the subassembly. The subassembly conduit communicates with a drill bit conduit to supply lubricant to the bearings. A replaceable metering tube is provided in the subassembly for controlling the flow of lubricant.

It has been found that it would be desirable, under certain circumstances, to alter the flow of lubricant to allow gaseous drilling fluid, or a mixture of lubricant and gaseous drilling fluid, to reach the bearings, for example, to flush out lubricant from the bearings which may have accumulated and broken down under the high temperature in the drill bit. Also, if the supply of lubricant is interrupted, for example when the lubricant supply is depleted, it would be desirable to have a flow of gaseous fluid directed to the bearings to provide back-up cooling.

Another approach in the prior art has been to use the gaseous drilling fluid itself to cool the cutting cone bearings. For example, in U.S. Pat. No. 4,080,091, a drill bit is disclosed which provides a conduit communicating between the hollow interior of the drill bit and the cutting cone bearings, to allow passage of drilling air to the bearings. In this arrangement, relatively cool drilling air is introduced to cool the cutting cone bearings and shafts, as they become heated during the drilling operation. U.S. Pat. No. 3,125,175 also discloses a structure which provides a conduit communicating between the hollow interior of the drill bit and the cutting cone bearings. In this structure, a ring member is provided in the drill bit, which reduces the quantity of air which enters the conduit, as compared to the quantity of air which exits in the vicinity of the cutting cones. Both of these systems suffer from the disadvantage that, although the bearings are cooled, they are not lubricated.

U.S. Pat. No. 2,814,464 discloses a drill bit structure providing a conduit between the drill bit interior and the cutting cone bearings, and suggests that the drilling fluid may consist of an air stream containing a fine spray of lubricant such as oil, to lubricate the cutting cone bearings. Of course, when oil is injected into the drilling air, oil is also contained in the air which exits at the drilling surface in the vicinity of the cutting cones. This is undesirable since it results in oiling the drilling surface and oiling of the dust and cuttings arising from the drilling operation.

Another gaseous fluid drilling system employing lubricant entrained in the gaseous drilling fluid is disclosed in U.S. Pat. No. 3,924,695. The disclosed drill bit structure includes a separator assembly, which acts to remove lubricant from the gaseous drilling fluid before it is discharged onto the drilling surface. The lubricant, removed from the gaseous stream, is then directed to the cutting cone bearings by way of a conduit provided in the drill bit. No means are disclosed for controlling or regulating the amount of lubricant applied to the bearings.

A drill bit structure providing for an internal storage source of liquid lubricant is disclosed in U.S. Pat. No. 4,375,242. In the drill bit, an air conduit is provided between the drill bit interior and a sealing O-ring, which supports the cutting cone on the bit. The pressure from the air conduit also acts to urge lubricant from the internal storage source, and supply the lubricant by way of a separate conduit to the cutting cone bearings for lubrication.

U.S. Pat. No. 2,831,660 discloses a drill bit providing a conduit interconnecting the hollow interior of the drill bit with the cutting cone bearings to supply gaseous drilling fluid to the bearings. A reservoir for lubricant is provided in the drill bit and a second conduit is provided to allow lubricant to pass from the reservoir to the first conduit, to be combined with the gaseous fluid being directed to the bearings. While the disclosed system is advantageous in that it permits a mixture of lubricant and gaseous fluid to be supplied to the bearings, no means are provided for metering or controlling the lubricant flow.

With the foregoing in mind, it is an object of the present invention to provide for an improved drill bit structure and drill assembly which enables a controlled flow of lubricant under pressure, which may be supplied, for example, from a storage means in a drilling subassembly, to be supplied to the bearings. At normal operating pressure, a flow of substantially entirely lubricant is metered to the cutting cone bearings. In an alternate mode of operation, lubricant is caused to combine with gaseous drilling fluid in a conduit means which communicates between the hollow interior of the drill bit and the cutting cone bearings. In this manner, a gaseous fluid and lubricant mixture is supplied through the conduit means at a controlled rate to the cutting cone bearings to provide both cooling and lubrication. In the event that the stored lubricant is depleted or exhausted, a flow of gaseous drilling fluid is directed to the bearings.

SUMMARY OF THE INVENTION

The present invention provides for a drill bit for use in a rotary drill system utilizing a source of gaseous fluid under pressure. The drill bit is provided with at least one rotary cutting cone for drilling into an earth formation, such as rock or coal. The bit is provided with a first conduit means, in the form of an air passage which extends from the hollow interior of the drill bit to the cutting cone bearings. A second conduit means is provided in the drill bit for receiving lubricant from an external storage source of lubricant under pressure, which may be contained in a drilling subassembly. The second conduit means is in the form of a lubricant passage which intersects with and provides lubricant to the first conduit means. Preferably, the second conduit means also contains replaceable orifice elements which regulate the amount of lubricant entering the second conduit means.

In a preferred embodiment, the drill bit is used in combination with a subassembly having a lubricant storage means, and wherein a pressure is exerted on the stored lubricant by the gaseous drilling fluid. In operation under normal operating pressures, a flow substantially entirely of lubricant is metered to the bearings in a controlled flow. By varying the pressure acting on the stored lubricant relative to the pressure existing within the drill bit interior, a lubricant and gaseous fluid mixture may be formed beyond the intersection of the first conduit and the second conduit. The resulting mixture is directed, through the first conduit means, to the cutting cones for cooling and lubrication of the cutting cone shafts and bearings. In the event the lubrication supply is exhausted, a flow of gaseous fluid is directed to the bearings as back-up protection.

DESCRIPTION OF THE INVENTION

The drill bit of the present invention is intended to be attached to a drill string or drilling subassembly, the drill string or subassembly having a lubricant storage means and means for supplying the lubricant to the drill bit.

Figure 1:
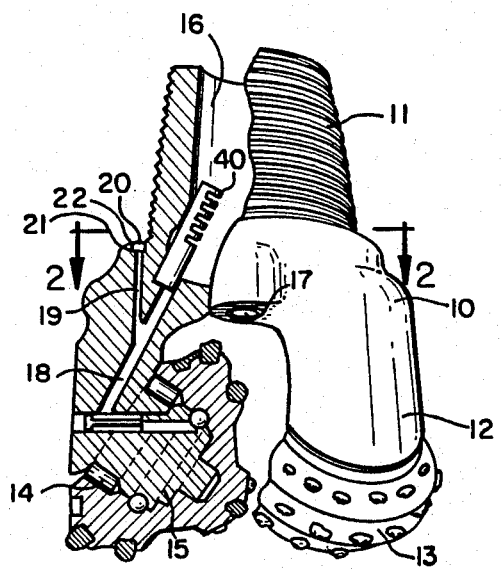
FIG. 1 is a cut-away perspective view of a drill bit of the present invention.

The drill bit of the present invention comprises a main body portion 10 as shown in FIG. 1. An upper nipple 11 attaches the drill bit to a drilling subassembly, or to the extension pipes forming a drill string. The nipple of the drill bit is threaded, so as to threadedly engage the tapered socket of a subassembly and form a firm connection therebetween. One or more leg portions 12 extend downwardly from the body portion 10 of the drill bit at circumferentially spaced intervals. Mounted for rotation in each leg portion 12 is a rotary cutter 13. It is generally preferred in the industry to use a drill bit having three cutting cones. Cutting cones 13 are rotatably mounted to the leg portion of the drill bit by bearings 14 and bearing shafts 15.

The drill bit contains a hollow interior portion 16 forming a chamber for receiving gaseous drilling fluid from the subassembly plenum chamber. The gaseous drilling fluid from chamber 16 is exhausted from the drill bit into the area of the cutting cones to pick up and remove the dust and cuttings which result from the drilling operation. The gaseous drilling fluid may be ejected through nozzles 17 located between the cutting cones. Alternatively, the nozzles may be omitted and the gaseous fluid ejected through a central orifice located between the cutting cones, as is known in the art. In the present case, the orifice in the drill bit must have sufficient restriction to provide an elevated pressure within the chamber 16.

Communicating between chamber 16 and the cutting cone bearings 14 and bearing shafts 15, is first conduit means 18 forming passage for the gaseous drilling fluid. First conduit means 18 allows gaseous drilling fluid, such as air, to pass from the hollow interior of the drill bit through the first conduit means to cool the cutting cone bearings 14 and bearing shafts 15.

Figure 2:
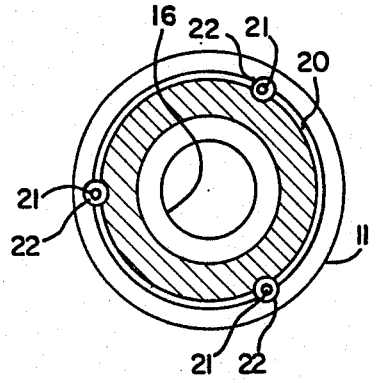
FIG. 2 is a cross-sectional view taken across line 2—2 of FIG. 1.

The drill bit of the present invention is also provided with a circumferential groove 20 surrounding the drill bit, as shown in FIG. 2, to form a reservoir for lubricant which is located in the surface of the drill bit surrounding the nipple 11. The circumferential groove, which preferably is approximately 3/16" wide by 3/16" deep, receives lubricant from, for example, a supply conduit 34 in a drilling subassembly, as described hereinafter in connection with FIG. 3. Second conduit means or bore 19 joins the first conduit means and connects circumferential groove 20 with first conduit means 18, and supplies lubricant from the groove 20 to the first conduit means 18 and to the bearings. The precise location of the junction where second conduit means 19 intersects with first conduit means 18 is a choice of design.

In one mode of operation, to be described more fully hereinafter, the lubricant supplied by second conduit means or bore 19 is picked up and combined with the gaseous drilling fluid in first conduit means 18, and the resulting mixture is supplied to the cutting cone bearings 14, to achieve both a lubricating and a cooling effect. In this mode of operation, lubricant build-up and heat breakdown at the bearings is avoided due to the continuous supply of fresh mixture provided to the bearings, the air in the mixture acting to flush out lubricant before it accumulates.

Means is provided to regulate the amount of lubricant supplied to the bearings. To this end, second conduit means 19 may be fitted with replaceable orifices, in the present instance annular rings 21. The diameter of the orifice in annular rings 21 may be varied to regulate the flow of lubricant supplied to the bearings. The annular rings 21 may be formed of metal, plastic, or any suitable material. The annular rings 21 are inserted into second conduit means 19 in the vicinity of circumferential groove 20, for example in a counter bore 22 at the mouth of the bore 19. When it is desired to modify the rate at which lubricant is supplied to the bearings, the user simply removes the drill bit from the subassembly, and replaces annular ring 21 with an annular ring having a different sized orifice, to provide the desired lubricant flow.

Figure 3:
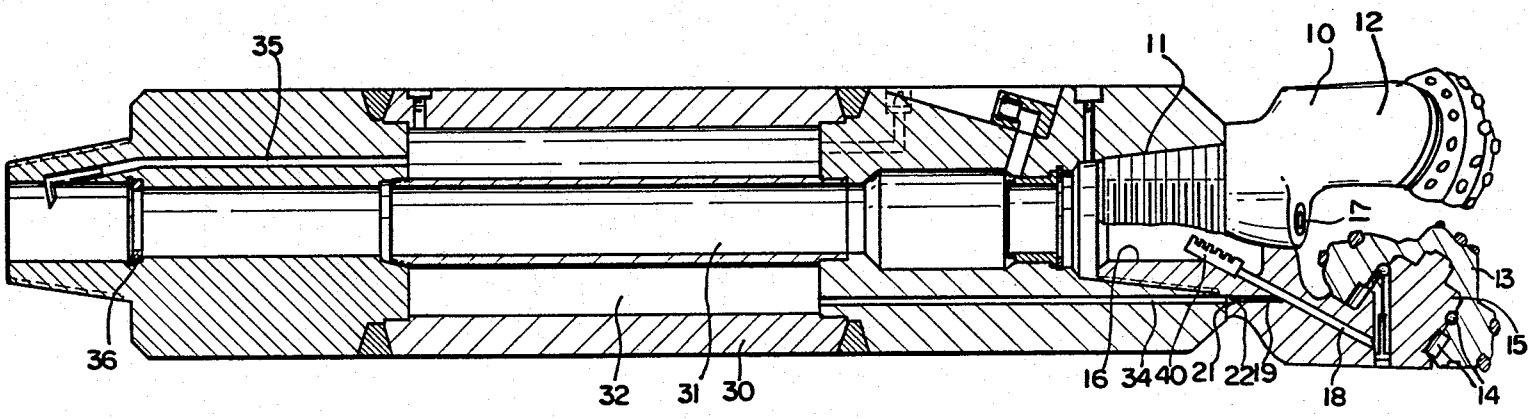
FIG. 3 is a cross-sectional view of a drill bit of the present invention attached to a subassembly having an internal storage supply of lubricant.

Referring to FIG. 3, the drill bit of the present invention is shown attached to a drilling subassembly. The drill bit of the present invention is designed to work in combination with a subassembly having a supply of lubricant contained therein. A subassembly of this type is shown, for example, in U.S. Pat. No. 4,541,494. Another subassembly having lubricant storage is shown in U.S. Pat. No. 3,029,881.

A representative subassembly comprises a housing 30 and a hollow plenum chamber 31. Gaseous drilling fluid from the drill line is supplied to plenum chamber 31, and thereafter to drill bit interior 16. The subassembly structure additionally contains lubricant storage means in the form of, for example, annular chamber 32 surrounding the housing. The flow of lubricant from the storage means may be effected by a pressure force acting on the lubricant, which may be accomplished in various ways. For example, a passageway 35 may be provided to allow communication between the pressurized gaseous fluid in the plenum chamber and the lubricant storage area. In this arrangement, the gaseous fluid acts as a pressure source forcing lubricant downwardly and into lubricant supply conduits 34, which are provided at spaced intervals around the circumference of the subassembly. A piston (not shown) may be provided in the annular chamber 32 to force lubricant from the chamber. It should be apparent that other types of pressure means are equally suitable to force lubricant from the storage means, for example, an expandable liner.

The lubricant forced through supply conduit 34 accumulates in the circumferential groove 20 on the drill bit. In the preferred embodiment, illustrated in FIG. 2, the circumferential groove extends entirely around the drill bit. This obviates the need to align supply conduit(s) 34 on the subassembly with individual bores or second conduit means 19 in the drill bit in order to supply lubricant to the second conduit means.

It has been found beneficial to the operation of the present invention for an orifice ring 36 to be placed in the plenum chamber of the subassembly in order to somewhat reduce the flow of gaseous fluid reaching plenum chamber 31. Orifice ring 36 also serves to allow control of the gaseous fluid pressure acting on the lubricant chamber 32 via conduit 35 relative to the amount of gaseous fluid entering the area of drill bit interior 16. To accomplish these functions, the orifice ring 36 should be located downstream from the pressure means acting on the lubricant storage in the subassembly, and upstream of the entrance to first conduit means 18 in the hollow interior chamber 16 of the drill bit.

In operation, by varying the pressure of the gaseous fluid as controlled by orifice ring 36, the flow of lubricant or gaseous fluid to the bearings can be varied or controlled between an all-lubricant flow, an all-gaseous fluid flow, or any desired intermediate mixture of lubricant and gaseous fluid. To provide an all or substantially all-lubricant flow through the first conduit 18 beyond its junction with the second conduit 19 to the bearings, the size of the restriction at orifice ring 36 is increased, providing a smaller opening, to provide a greater pressure of gaseous fluid acting upon the lubricant storage means, while a somewhat reduced pressure in chamber 31 is applied to drill bit interior 16 and, hence, the first conduit means 18. Sufficient force to achieve continuous lubricant flow from the chamber 32 is thereby maintained. It has been found that, for this mode of operation to be achieved, the pressure of the gaseous fluid upstream of orifice ring 36 should be about 12–15 psi higher than the gaseous fluid pressure downstream of the orifice, i.e. in drill bit interior 16.

One expedient arrangement for controlling the lubricant flow is to place an orifice ring directly at the connection between the subassembly and the drill string below passageway 35. This allows the orifice ring to be removed or replaced simply by removing the subassembly from the drill string.

Instead of receiving lubricant from a supply conduit in a subassembly, the drill bit of the present invention may receive lubricant that is supplied by a conduit in the drill string from a surface-mounted supply, as shown in U.S. Pat. No. 4,508,183. In this arrangement, the drill bit may be attached directly to the extension pipe, and the circumferential groove 20 may receive lubricant directly from the drill string conduit.

In actual operation of the structure of the invention, it has been found that, at the operating pressures for the gaseous drilling fluid commonly employed in the drill string, the flow to the bearings through first conduit 18 beyond the junction with the second conduit is substantially entirely lubricant. The flow of lubricant to the bearings and the exclusion of any significant amount of gaseous fluid is believed to result from the generally higher pressure upstream of orifice ring 36. As noted previously, orifice ring 36 increases the back pressure above the orifice ring 36 and reduces the quantity of flow of gaseous fluid in plenum chamber 31. Hence, a greater pressure is exerted upon the lubricant storage means 32 by way of supply conduit 35, than is present in the plenum chamber 31 and hollow bit interior 16 after the gaseous fluid has passed through orifice ring 36, which results in a lesser pressure gaseous fluid flow inside plenum chamber 31 and in hollow drill bit interior 16. Accordingly, at the junction between first conduit 18 and second conduit 19 in the drill bit, the gaseous fluid from the bit interior portion 16 is substantially excluded from the outer portion of the conduit 18 beyond its junction with the conduit 19. Hence, the flow reaching the cutting cone bearings, through the outer portion of first conduit means 18, is substantially entirely lubricant received at a higher pressure from conduit 19, with the general result that no substantial amount of gaseous fluid reaches the bearings during normal operation. It has been found most beneficial to have the pressurized lubricant metered to the bearings in a controlled manner. As noted, the pressure acting on the lubricant flow can be controlled by varying the size of the orifice ring 36. The lubricant flow rate can be further controlled by varying the size of annular rings 21. In the preferred operation of the system, rings 21 are sized such that a limited quantity of lubricant is provided for packing the bearings, without having an excess lubricant flow from the bearings into the drill hole which might otherwise permit cuttings to float back into the bearings and bearing supports.

It should also be appreciated that, in the preferred operation of the system, when the flow of lubricant is interrupted or discontinued, a flow of gaseous fluid will be directed to the bearings through the outer portion of the first conduit means 18. Accordingly, in the event the supply of lubricant in storage means 32 is exhausted, the bearings are nonetheless given some degree of protection by the cooling effect of gaseous fluid supplied to the bearings by first conduit means 18 until such time as the lubricant supply is replenished or reestablished.

To alter the operation of the system to provide a mixture of lubricant and gaseous fluid to the bearings, which may be desirable in certain operations, orifice ring 36 is replaced with a ring having a larger-sized opening, to lessen the back pressure on the lubricant supply to the desired degree. Further towards this end, annular rings 21 may be replaced with a more constricted-sized ring. The precise size of rings 36 and 21 may vary depending on the pressure of the system and the composition of the mixture to be provided, and are readily determined by routing engineering, or by observation at any given operating pressure.

In a preferred embodiment of the invention, a perforated member in the form of a slotted tube 40 is fitted into the mouth of the first conduit 18 at the bit chamber 16. The slotted tube 40 is preferably formed with semicircular openings along its axis to provide a grill to act to filter dirt, stone or other heavy material which may be present in the gaseous drilling fluid in bit chamber 16 from entering the first conduit means 18. As previously mentioned, air flow through filter tube 40 and first conduit 18 provides the back-up air flow for cooling the bearings when the oil lubricant flow fails.

We claim:

1. In combination with a drilling system having a drill string, a source of gaseous fluid at a controlled pressure providing a flow in the drill string, and lubricant supply means providing a forced flow of lubricant under the pressure of said source of gaseous fluid, said drill string including a flow restricting orifice which controls the flow of gaseous fluid in the drill string and regulates the gaseous fluid pressure exerted on said lubricant supply means, a drill bit comprising:

(a) a body portion having a hollow interior;

(b) a shank portion extending from said body portion for attachment of the drill bit to the drill string and having an opening for receiving the gaseous fluid flow from the drill string for conducting the flow into the hollow interior of the body portion, the body portion having at least one leg portion extending from said body portion;

(c) at least one cutting cone supported on said leg portion by bearings;

(d) the body portion having at least one discharge opening communicating with said hollow interior for exhausting gaseous fluid from the hollow interior onto the surface being drilled;

(e) at least one first conduit means extending through the leg portion providing gaseous passage means communicating between said hollow interior of the body portion and said cutting cone bearings, the first conduit means receiving a gaseous fluid flow from the interior of the body portion; and (f) second conduit means communicating with said first conduit means at a junction and extending through the body portion providing passage means for the lubricant, and communicating at one end with said forced flow of lubricant from said lubricant supply means and at the other end with said first conduit means at said junction.

2. The combination set forth in claim 1 wherein the lubricant supply means is connected to the source of gaseous fluid upstream of the orifice to control the pressure of the lubricant supply means.

3. The drill bit set forth in claim 1 comprising three leg portions, three cutting cones supported thereon, three first conduit means, and three second conduit means.

4. The drill bit set forth in claim 3 wherein said at least one discharge opening consists of nozzle means connected to said hollow interior and opening between adjacent cutting cones.

5. The drill bit set forth in claim 1 wherein flow regulating means are provided in said second conduit means for controlling the flow of lubricant through said second conduit means.

6. The drill bit set forth in claim 5 wherein said flow regulating means consists of replaceable annular rings.

7. The drill bit set forth in claim 1 wherein the first conduit means contain a perforated member at its inner end where it communicates with the hollow bit interior.

8. In combination with a gaseous fluid drilling subassembly having a storage means for lubricant stored under the pressure of the gaseous drilling fluid, and having replaceable orifice means for regulating the pressure exerted by the gaseous fluid upon the stored lubricant, an earth boring drill bit comprising:

a. a body portion having a hollow interior;

b. a shank portion extending from said body portion for attachment of the drill bit to the drill string and having an opening for receiving gaseous fluid from the subassembly for conducting the flow into the hollow interior of the body portion, the body portion having at least one leg portion extending from said body portion;

c. at least one cutting cone supported on said leg portion by bearings;

d. the body portion having at least one discharge openings communicating with said hollow interior for exhausting gaseous fluid from the hollow interior onto the surface being drilled;

e. at least one first conduit means extending through the leg portion providing gaseous passage means communicating between said hollow interior of the body portion and said cutting cone bearings, the first conduit means receiving the gaseous fluid flow from the interior of the body portion; and f. second conduit means communicating with said first conduit means at a junction and extending through the body portion providing passage means for lubricant, and communicating at one end with the storage means in the subassembly and at the other end with the first conduit means at said junction;

whereby when said storage means contains lubricant therein, a flow of lubricant within said second conduit means is provided at a controlled flow rate through said first conduit to the bearings with or without a flow of gaseous fluid.

9. The combination set forth in claim 8 further comprising replaceable annular rings within said second conduit means for further regulating the flow of lubricant to the first conduit means.

10. An earth boring drill bit for use in a drilling system having a source of gaseous fluid at a controlled pressure providing a flow in a drill string of the system and having a lubricant supply means containing lubricant under the pressure of said source of gaseous fluid for providing a forced flow of lubricant in the drill string, the drill bit comprising:

(a) a body portion having a hollow interior;

(b) a shank portion extending from said body portion for attachment of the drill bit to the drill string and having an opening for receiving the gaseous fluid flow from the drill string for conducting the flow into the hollow interior of the body portion, the body portion having at least one leg portion extending from said body portion;

(c) at least one cutting cone supported on said leg portion by bearings;

(d) the body portion having at least one discharge opening communicating with said hollow interior for exhausting gaseous fluid from the hollow interior onto the surface being drilled;

(e) at least one first conduit means extending through the leg portion providing gaseous passage means communicating between said hollow interior of the body portion and said cutting cone bearings, the first conduit means receiving a gaseous fluid flow from the interior of the body portion; and (f) second conduit means communicating with said first conduit means at a junction and extending through the body portion providing passage means for the lubricant, and communicating at one end with said forced flow of lubricant from said lubricant supply means and at the other end with said first conduit means at said junction; and (g) a flow-restricting orifice ring controlling the flow of gaseoous fluid in the drill string and wherein the lubricant supply means is connected to the source of gaseous fluid upstream of the orifice ring to control the pressure exerted on the lubricant supply means.

* * * * *